US010461411B2

(12) United States Patent
Choi et al.

(10) Patent No.: US 10,461,411 B2
(45) Date of Patent: Oct. 29, 2019

(54) ANTENNA AND ELECTRONIC DEVICE INCLUDING THE SAME

(71) Applicant: Samsung Electronics Co., Ltd., Gyeonggi-do (KR)

(72) Inventors: Seungbum Choi, Gyeonggi-do (KR); Juneseok Park, Gyeonggi-do (KR); Sunghyun Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 430 days.

(21) Appl. No.: 15/008,730

(22) Filed: Jan. 28, 2016

(65) Prior Publication Data

US 2016/0218422 A1 Jul. 28, 2016

(30) Foreign Application Priority Data

Jan. 28, 2015 (KR) ..... 10-2015-0013193

(51) Int. Cl.
*H01Q 1/38* (2006.01)
*H01Q 1/24* (2006.01)
*H01Q 21/28* (2006.01)

(52) U.S. Cl.
CPC ..... *H01Q 1/38* (2013.01); *H01Q 1/243* (2013.01); *H01Q 21/28* (2013.01)

(58) Field of Classification Search
CPC ..... H01Q 1/243–245; H01Q 19/09
See application file for complete search history.

(56) References Cited

U.S. PATENT DOCUMENTS 7,651,345 B2 * 1/2010 Tomioka ..... H01Q 1/2258 439/573
8,111,201 B2 * 2/2012 Tsujimura ..... H01Q 1/22 343/700 MS
9,698,475 B2 * 7/2017 Katayama ..... H01Q 1/243
2012/0176278 A1 7/2012 Merz et al.

FOREIGN PATENT DOCUMENTS

KR 10-1054579 B1 8/2011
KR 10-1381135 B1 4/2014

* cited by examiner

*Primary Examiner* — Jessica Han
*Assistant Examiner* — Amal Patel
(74) *Attorney, Agent, or Firm* — Cha & Reiter, LLC

(57) ABSTRACT

An electronic device may include thin antennas disposed proximate a rear or front surface. An antenna structure may be disposed at a portion of a first surface or a second surface of a non-metal structure within the device, and is electrically connected to the metal structure. The antenna structure may comprise: a first bonding layer attached to a portion of the first surface or the second surface, where an opening is formed in the first bonding layer at a location of the metal structure; a antenna element pattern arranged on the first bonding layer and electrically connected to the metal structure through the opening; a second bonding layer arranged on the antenna element pattern; and an insulation layer arranged on the second bonding layer.

15 Claims, 15 Drawing Sheets

ANTENNA AND ELECTRONIC DEVICE INCLUDING THE SAME

CLAIM OF PRIORITY

This application claims the priority under 35 U.S.C. § 119(a) to Korean Application Serial No. 10-2015-0013193, which was filed in the Korean Intellectual Property Office on Jan. 28, 2015, the entire content of which is hereby incorporated by reference.

TECHNICAL FIELD

Various embodiments of the present disclosure relate to an antenna and an electronic device including a thin antenna.

BACKGROUND

In recent years, much effort has been made to slim down and improve the durability of portable electronic devices such as smart phones and tablet PCs. Such devices have become gradually slimmed to satisfy the purchase demands of consumers, while maintaining other requisite performance metrics. Among the many components contributing to the size and thickness of today's portable devices are the internal antennas. It is desirable to provide antennas that occupy minimal internal space within the device.

SUMMARY

An electronic device may have a Planar Inverted-F Antenna (PIFA) or a monopole radiation body as a basic structure. The volume and number of the mounted antenna radiation bodies may be determined depending on the frequencies, bandwidths, or types of services. For example, one or more antennas may satisfy multiple wireless communication services, such as GSM, LTE, BT, GPS, and/or Wi-Fi, which are operated at various bandwidths. In general, electronic devices that have been gradually slimmed should satisfy all the above-mentioned communication bandwidths in a given mounting space of an antenna radiation body, should have an electric field that is equal to or less than a Specific Absorption Rate (SAR) reference value by which harmfulness to the human body is determined, and should overcome a radiation performance deterioration phenomenon that occurs due to a peripheral mechanism (for example, a metal housing, a metal bezel, or an electronic component that uses a metal material).

With some conventional devices, an antenna is configured such that an antenna radiation body is arranged on an antenna carrier that has a predetermined height and is arranged in the interior of an electronic device. However this configuration is becoming less common due to the gradual slimness of the electronic devices. Instead, methods of arranging an antenna on a substrate or on an outer surface of a housing that generally occupies less volume, have been proposed.

According to various related art embodiments, an antenna is arranged in at least one area of a housing of an electronic device in an in-mold type, but this structure is also being discouraged due to the volume of the molded object. In recent years, a Flexible Printed Circuit Board (FPCB) type antenna arranged in a housing through attachment has appeared.

However, because the FPCB type antenna radiation body should also include a cover layer, which has a predetermined thickness, and as connection errors at the antenna terminal part become frequent due to the flexible structure, there is a limit in decreasing the thickness of the antenna, which in turn increases the entire thickness of the electronic device, resulting in retrogression in slimness.

Various embodiments of the present disclosure provide an antenna and an electronic device including the same.

Various embodiments of the present disclosure also provide an antenna which achieves a desired performance, but which may have a small profile so as to reduce an allocated mounting space and/or increasing the degree of freedom of the pattern of the antenna radiator, and an electronic device including the same.

According to an aspect of the present disclosure, there is provided an electronic device including a front glass cover defining a front surface of the electronic device, and a rear cover defining a rear surface of the electronic device. A display may include a screen area exposed through the front cover. A non-metal structure (e.g., a portion of a rear housing) located inside the electronic device may include a first surface facing the front cover and a second surface facing the rear cover. A metal structure may pass through a portion of the non-metal structure and extend from the first surface to the second surface of the non-metal structure. An antenna structure may be disposed at a portion of the first surface or the second surface and be electrically connected to the metal structure. The antenna structure may include: a first bonding layer attached to a portion of the first surface or the second surface, where an opening is formed in the first bonding layer at a location of the metal structure; a antenna element pattern arranged on the first bonding layer and electrically connected to the metal structure through the opening; a second bonding layer arranged on the antenna element pattern; and an insulation layer arranged on the second bonding layer.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
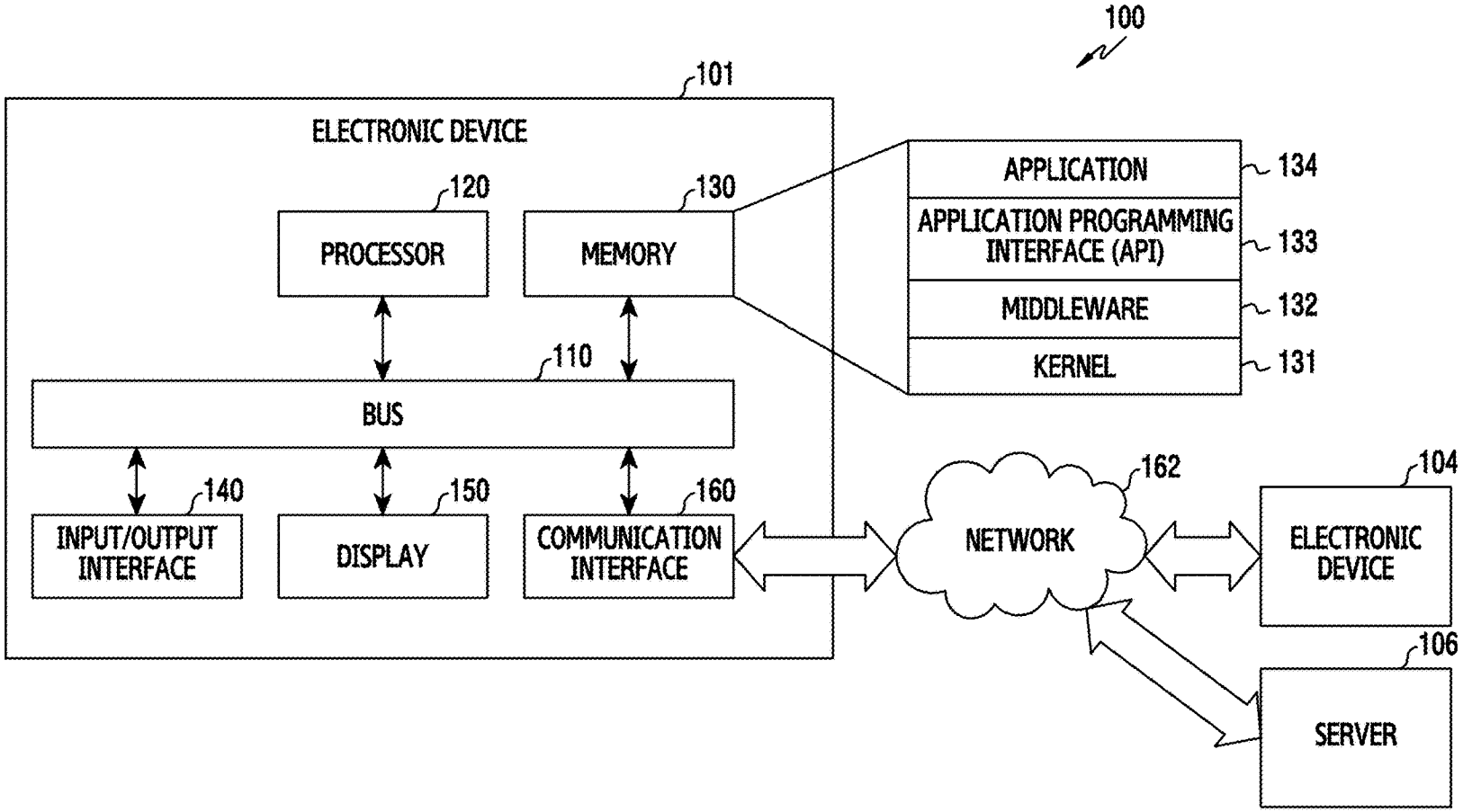
FIG. 1 illustrates a network environment containing an electronic device according to various embodiments of the present disclosure.

Herein, embodiments of the present disclosure are described with reference to the accompanying drawings. Although specific embodiments of the present disclosure are illustrated in the drawings and relevant detailed descriptions are provided to assist in a comprehensive understanding of various embodiments of the present disclosure, the various specific details in the following description are provided to assist in a comprehensive understanding, but the embodiments are merely examples. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to their dictionary meanings, but are used to enable a clear and consistent understanding of the present disclosure. Accordingly, it should be apparent to those skilled in the art that the following description of various embodiments of the present disclosure is provided for illustration purposes only and not for the purpose of limiting the present invention, as defined by the appended claims and equivalents thereof.

It is to be understood that the singular forms "a," "an," and "the" include plural forms, unless the context clearly indicates otherwise. Thus, for example, reference to "a component surface" includes reference to one or more of such surfaces.

The term "substantially" used in describing the embodiments of the present disclosure and in the claims indicates that a recited characteristic, parameter, or value need not be achieved exactly, but that deviations or variations, e.g., tolerances, measurement error, measurement accuracy limitations and other factors known to those of skill in the art, may occur in amounts that do not preclude the effect that the characteristic was intended to provide.

The terms "include" and "may include" used in describing the embodiments of the present disclosure and in the claims indicate the presence of one or more corresponding functions, operations, elements and the like, and do not limit additional functions, operations, elements and the like. In addition, the terms "include" and "have" used in describing the embodiments of the present disclosure indicate that the presence of features, characteristics, numbers, steps, operations, elements, parts and combinations thereof, and do not preclude the presence or addition of one or more other features, numbers, steps, operations, elements, parts, or a combination thereof.

As used herein, the term "or" used in describing the embodiments of the present disclosure includes any and all combinations of words enumerated together. For example, "A or B" may include either A or B, or may include both A and B.

Although terms such as "first", "second" used in describing various the various embodiments of the present disclosure may modify various elements of the various embodiments, these terms do not limit the corresponding elements. For example, these terms do not limit an order or an importance of the corresponding constituent elements. These terms may be used to distinguish one constituent element from another constituent element. For example, a first user device and the second user device are both user devices, and indicate different user devices. For example, a first constituent element may be referred to as a second constituent element, and similarly, the second constituent element may be referred to as the first constituent element without departing from the scope of the present disclosure.

It will be understood that, when an element is mentioned as being "connected" to or "accessing" another element, the element may be directly connected to, coupled to, or accessing the other element, and there may be intervening elements present between the two elements. On the other hand, when an element is mentioned as being "directly connected" to or "directly accessing" another element, an intervening elements does not exist between the element and another element.

Unless otherwise defined, all terms, including technical and scientific terms, used herein have the same meaning as commonly understood by those of ordinary skill in the art. It will be further understood that terms, such as those defined in commonly used dictionaries, should be interpreted as having a meaning that is consistent with their meaning in the context of the relevant art and the various embodiments of the present disclosure, and should not be interpreted in an idealized or overly formal sense unless clearly defined herein.

An electronic device according to embodiments of the present disclosure includes an antenna capable of performing a communication function in at least one frequency band. For example, the electronic device may be a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a Moving Picture Experts Group Phase 1 or phase 2 (MPEG-1 or MPEG-2) audio layer 3 (MP3) player, a mobile medical device, a camera, and a wearable device (e.g., a Head-Mounted-Device (HMD), such as electronic glasses, electronic clothes, an electronic bracelet, an electronic necklace, an electronic appcessory, an electronic tattoo, a smart watch, and the like).

According to certain embodiments of the present disclosure, the electronic device may be a smart home appliance having an antenna. For example, the smart home appliance may include at least one of a television (TV), a Digital Versatile Disc (DVD) player, an audio player, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments of the present disclosure, the electronic device including the antenna may be one of various medical devices (e.g., Magnetic Resonance Angiography (MRA), Magnetic Resonance Imaging (MRI), Computed Tomography (CT), an imaging equipment, an ultrasonic instrument, and the like), a navigation device, a Global Positioning System (GPS) receiver, an Event Data Recorder (EDR), a Flight Data Recorder (FDR), a car infotainment device, electronic equipment for a ship (e.g., a vessel navigation device, a gyro compass, and the like), avionics, a security device, a car head unit, an industrial or domestic robot, an Automatic Teller Machine (ATM), a Point Of Sales (POS) device, and the like.

According to certain embodiments of the present disclosure, the electronic device may be part of at least one of an item of furniture or a building/structure including an antenna. The electronic device may be an electronic board, an electronic signature input device, a projector, or any of various measurement machines (e.g., water supply, electricity, gas, a propagation measurement machine, and the like).

The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments may refer to a person who uses the electronic device or a device which uses the electronic device (e.g., an artificial intelligence (AI) electronic device).

FIG. 1 illustrates a network environment including an electronic device 101 according to an embodiment of the present disclosure. Electronic device 101 may include a bus 110, a processor 120, a memory 130, an input/output interface 140, a display 150, and a communication interface 160.

The bus 110 is a circuit for connecting the aforementioned elements (e.g., the processor 120, the memory 130, the input/output interface 140, the display 150, and the communication interface 160) to each other and for delivering communication (e.g., a control message) between the aforementioned elements.

The processor 120 receives an instruction from the aforementioned different elements (e.g., the memory 130, the input/output interface 140, the display 150, and the communication interface 160) via the bus 110, and thus may interpret the received instruction and execute arithmetic processing or data processing according to the interpreted instruction.

The memory 130 stores an instruction or data received from the processor 120 or different elements or generated by the processor 120 or the different elements. The memory 130 includes programming modules, such as a kernel 131, a middleware 132, an application programming interface (API) 133, and an application 134. Each of the aforementioned programming modules may consist of software, firmware, or hardware entities or may consist of at least two or more combinations thereof.

The kernel 131 controls or manages the system resources (e.g., the bus 110, the processor 120, the memory 130, and the like) used to execute an operation or function implemented in the middleware 132, the API 133, or the application 134. In addition, the kernel 131 provides a controllable or manageable interface by accessing individual constituent elements of the electronic device 101 in the middleware 132, the API 133, or the application 134.

The middleware 132 performs a mediation role so that the API 133 or the application 134 communicates with the kernel 131 to exchange data. In addition, regarding task requests received from the application 134, the middleware 132 controls (e.g., schedules or load balances) the task requests by using a method of assigning a priority for using a system resource of the electronic device 101 to at least one of the application 134.

The API 133 includes at least one interface or function (e.g., an instruction) for file control, window control, video processing, character control, and the like, as an interface capable of controlling a function provided by the application 134 in the kernel 131 or the middleware 132.

The application 134 may include a Short Message Service (SMS)/Multimedia Messaging Service (MMS) application, an e-mail application, a calendar application, an alarm application, a health care application (e.g., an application for measuring a physical activity level, a blood sugar level, and the like) or an environment information application (e.g., atmospheric pressure, humidity, or temperature information). Additionally or alternatively, the application 134 may be an application related to an information exchange between the electronic device 101 and an external electronic device 104 or a server 106. The application related to the information exchange includes a notification relay application for relaying specific information to the external electronic device 104 or a device management application for managing the external electronic device.

The notification relay application includes a function of relaying notification information generated in another application (e.g., an SMS/MMS application, an e-mail application, a health care application, an environment information application, and the like) of the electronic device 101 to the external electronic device 104 or server 106. Additionally or alternatively, the notification relay application receives notification information from the external electronic device 104, and provides the notification information to the user.

The device management application manages a function for at least one part of the external electronic device 104 which communicates with the electronic device 101. Examples of the function include turning on/turning off the external electronic device 104 itself (or some components thereof) or adjusting illumination or resolution of a display, and managing (e.g., installing, deleting, or updating) an application which operates in the external electronic device 104 or a service (e.g., a call service or a message service) provided by the external electronic device 104.

The application 134 includes an application specified according to attribute information (e.g., an electronic device type) of the external electronic device 104. For example, if the external electronic device 104 is an MP3 player, the application 134 may include an application related to a music play. Similarly, if the external electronic device 104 is a mobile medical device, the application 134 may include an application related to health care. The application 134 may include at least one of a specified application in the electronic device 101 or an application received from the external electronic device 104.

The input/output interface 140 relays an instruction or data input from a user by using a sensor (e.g., an acceleration sensor, a gyro sensor, and the like) or an input device (e.g., a keyboard or a touch screen) to the processor 120, the memory 130, or the communication interface 160, for example, via the bus 110. For example, the input/output interface 140 provides data regarding a user's touch input via the touch screen to the processor 120. In addition, the input/output interface 140 outputs an instruction or data received from the processor 120, the memory 130, or the communication interface 160 to an output device (e.g., a speaker or a display), for example, via the bus 110. For example, the input/output interface 140 outputs audio data provided by using the processor 120 to the user via the speaker.

The display 150 displays a variety of information (e.g., multimedia data or text data) to the user.

The communication interface 160 facilitates communication between the electronic device 101 and the external electronic device 104 or the server 106. The communication interface 160 includes an antenna 500 (FIG. 5), examples of which are described hereinafter. The communication interface 160 may communicate with the external electronic device 104 and the server 106 by being connected with a network 162 through wireless communication or wired communication.

The wireless communication includes, for example, at least one of Wi-Fi, Bluetooth (BT), Near Field Communication (NFC), GPS, and cellular communication (e.g., LTE, LTE-advanced (LTE-A), Code Division Multiple Access (CDMA), wideband CDMA (WCDMA), universal mobile telecommunication system (UMTS), Wireless Broadband (WiBro), Global System for Mobile communication (GSM), and the like).

The wired communication includes, for example, at least one of a Universal Serial Bus (USB), High Definition Multimedia Interface (HDMI), Recommended Standard (RS)-232, and Plain Old Telephone Service (POTS).

The network 162 may be a telecommunications network. The telecommunications network includes at least one of a computer network, Internet, Internet of things, and a telephone network. A protocol (e.g., a transport layer protocol, a data link layer protocol, or a physical layer protocol) for communication between the electronic device 101 and an external electronic device 104 may be supported in at least one of the application 134, the application programming interface 133, the middleware 132, the kernel 131, and the communication interface 160.

Various embodiments of the present disclosure illustrate a separable cover member that contributes as an outer housing of an electronic device, and an antenna disposed in the vicinity of the separable cover In other embodiments, an integral cover member, which directly contributes as a rear surface of an electronic device without being separated, and an antenna arranged around the cover, may be provided.

Figure 2A:
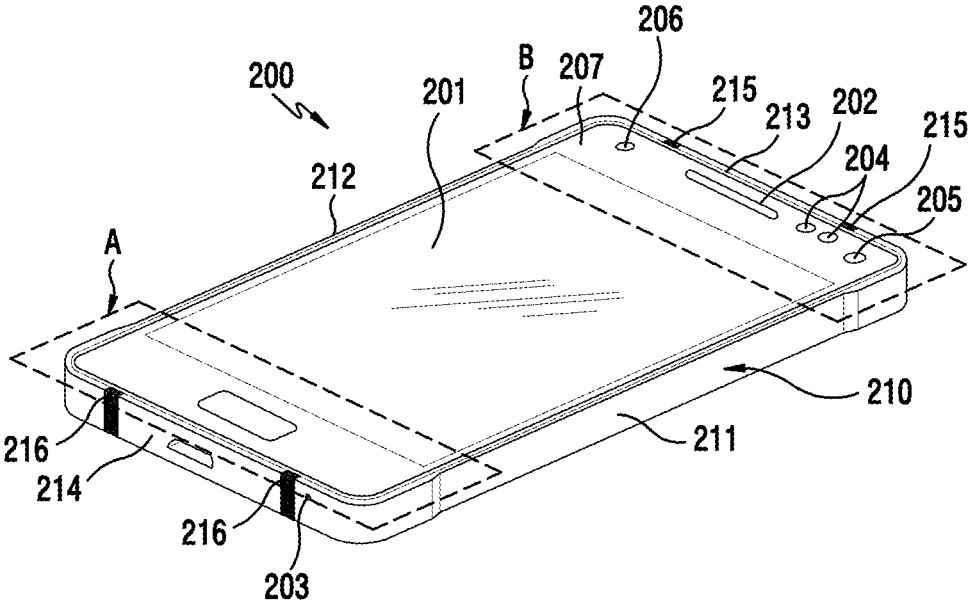
FIG. 2A is a front perspective view of an electronic device according to various embodiments of the present disclosure.

FIG. 2A is a front perspective view of an electronic device 200 according to various embodiments of the present disclosure. Electronic device 200 may include a display 201 that may be installed on a front surface 207 of the electronic device 200. A speaker unit 202 for outputting audio may be installed above the display 201. A microphone unit 203 for receiving input sounds may be installed below the display 201. The display 201 may have a front glass cover, through which a screen area of the display 201 is exposed. Other regions which include portions of "A" and "B" of the front glass cover may be provided outside the screen area.

Components for performing various functions of the electronic device 200 may be disposed around the speaker unit 202. The components may include one or more sensor modules 204. The sensor module(s) 204 may include, for example, at least one of an illumination intensity sensor (for example, a light sensor), a proximity sensor, an infrared ray sensor, and an ultrasonic wave sensor. The components may further include a camera unit 205 and/or an LED indicator 206 to inform the user of state information of the electronic device 200.

Electronic device 200 may include a metal bezel 210 which may contribute as at least a portion of a metal housing. Metal bezel 210 may be arranged along a periphery of the electronic device 200 and may be arranged to extend to at least a portion of the rear surface of the electronic device 200, which extends to the periphery of the electronic device 200. Metal bezel 210 may have a width in the "Z" direction of device 200 (i.e., the thickness direction), so as to define the thickness of the electronic device 200 along the periphery of the electronic device 200. Metal bezel 210 may have a configuration in the form of a loop. In an alternative design, metal bezel 210 may be formed in a manner that contributes to just a portion of the thickness of the electronic device 200. In another variant, metal bezel 210 may only be arranged in a portion of the periphery of the electronic device 200. Metal bezel 210 may include one or more "segmental" parts 215 and 216, and unit bezel parts 211, 212, 213 and 214, which are separated by the segmental parts 215 and 216, may be utilized as antenna radiation bodies.

Metal bezel 210 may have a loop shape along the periphery of the electronic device 200 and may be arranged in a manner that contributes to the entire thickness of the electronic device 200. When the electronic device 200 is viewed from the front side, the metal bezel 210 may have a right bezel part 211, a left bezel part 212, an upper bezel part 213, and a lower bezel part 214. Here, the above-described unit bezel parts 214 and 215 may contribute as unit bezel parts formed by the segmental parts 215 and 216.

An antenna may be arranged in area A and/or area B of the electronic device 200 that is least influenced when the electronic device 200 is gripped. At least a portion of area A and/or B may be disposed outside the screen area of the display 201 exposed through the front glass cover. An antenna part may also be arranged on at least one of the opposite side surfaces of the electronic device 200 at least partially outside of areas A and area B, and may be oriented in the lengthwise direction of the electronic device 200.

An antenna within device 200 may be a Flexible Printed Circuit Board (FPCB) type antenna. Hereinafter, such type of antenna may be referred to as a Thin FPCB Antenna (TFA).

The TFA may be arranged in such a manner that it is attached to the rear housing of the electronic device 200. In the TFA, electric power may be fed to a PCB in the interior of the electronic device 200 by an electrical medium means. In other words, RF signal power may be transferred from the TFA to the PCB during a receive operation, or from the PCB to the TFA during a transmit operation. An antenna terminal of the TFA may be electrically connected to a metal structure (for example, a metal bezel) of the above-described electronic device 200. The antenna terminal of the TFA may be arranged in such a manner that it makes direct contact with a metal member (for example, an island flange, a metal pillar, a metal flange, or an extrusion pin) independently arranged on the rear housing. The metal member may include various metallic members that may electrically connect the TFA and a connection point on the PCB.

Figure 2B:
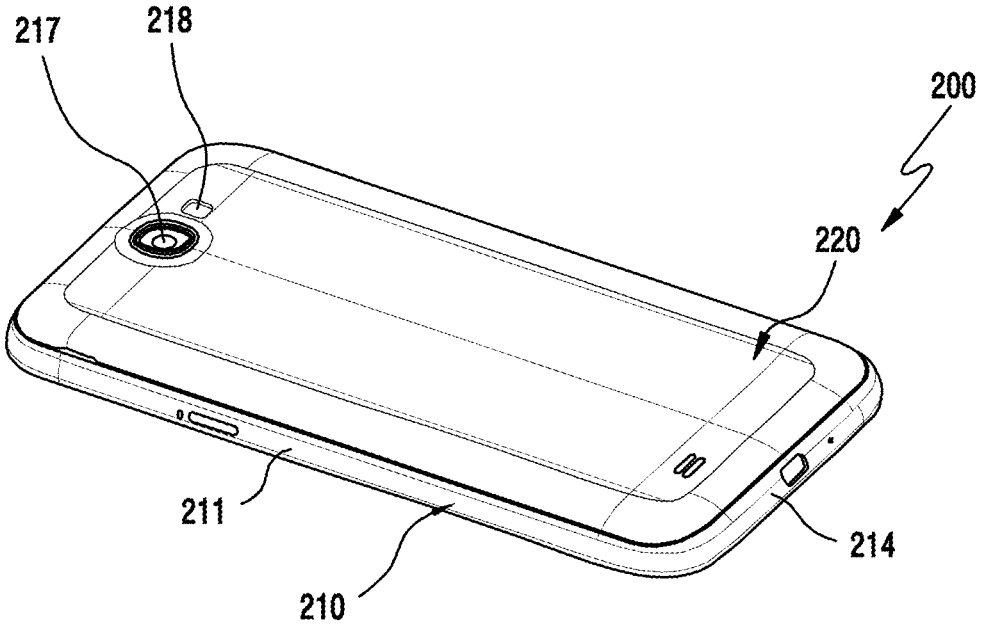
FIG. 2B is a rear perspective view of an electronic device according to various embodiments of the present disclosure.

FIG. 2B is a rear perspective view of the electronic device 200 according to various embodiments of the present disclosure. A cover member 220 may be further installed at the rear side of device 200 and thereby define part of the rear surface of the electronic device 200. (Cover member 220 may also be referred to as a "rear cover".) The cover member 220 may be a battery cover for protecting a battery pack detachably installed in the electronic device 200 and making the external appearance of the electronic device 200 appealing. Alternatively, cover member 220 may be integrally formed with the electronic device 200 to contribute as a rear housing of the electronic device. (When the cover member is integrally formed with the rear housing, a "rear cover" may be a rear wall of the electronic device 200.) Cover member 220 may be formed of various materials such as a metal, glass, a composite material, and a synthetic resin. A camera unit 217 and a flash 218 may be arranged on the rear surface of the electronic device 200.

When a battery pack is integrally applied to the interior of the electronic device 200, the cover member 220 may be replaced by a rear wall of the rear housing. In this case, at least one area of the rear housing that constitutes an external appearance of the electronic device 200 may be formed of a metal material.

Figure 3:
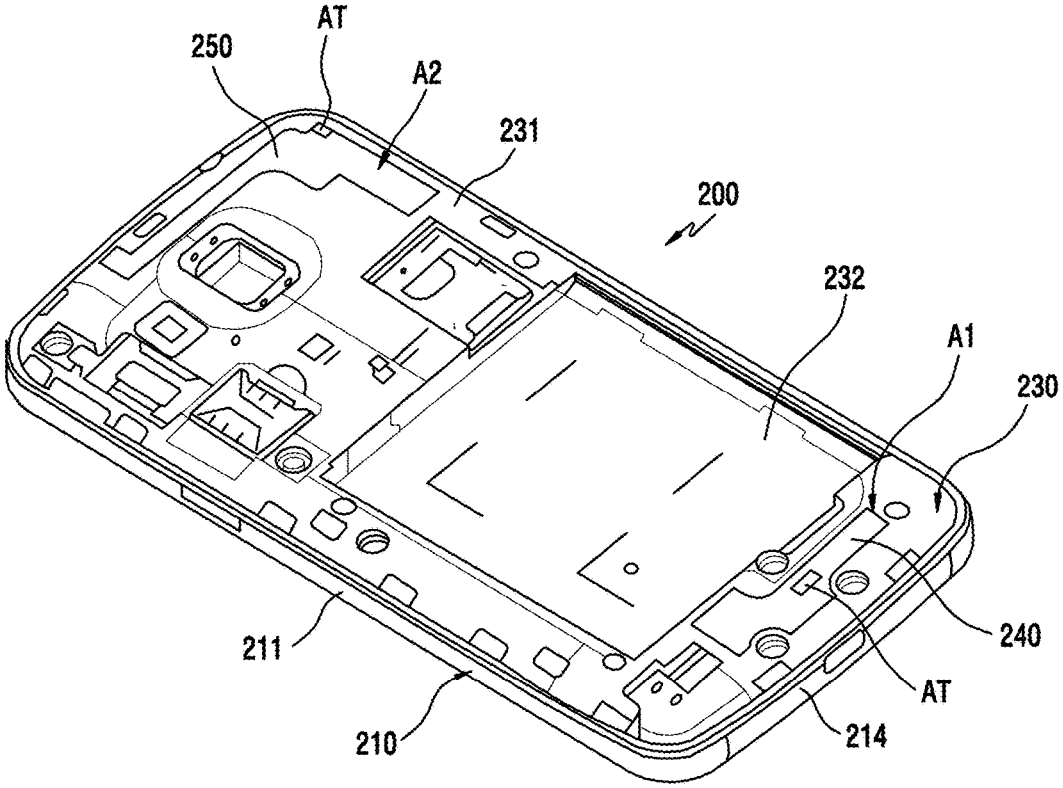
FIG. 3 is a perspective view illustrating a state in which a Thin FPCB Antenna (TFA) is arranged in a rear housing of an electronic device according to various embodiments of the present disclosure.

FIG. 3 is a perspective view illustrating a state in which Thin FPCB Antennas (TFAs) 240 and 250 are arranged in the rear housing 230 of the electronic device 200 according to various embodiments of the present disclosure. The view of FIG. 3 illustrates a configuration of a cover member mounting surface 231 of the rear housing 230, shown with the cover member 220 of the electronic device 200 removed. the cover member mounting surface 231 may include a battery pack mounting part 232 for accommodating a battery pack.

In the electronic device 200, one or more antennas may be arranged on the cover member mounting surface 231. The one or more antennas may include a first antenna A1 arranged on the lower side of the electronic device 200, and a second antenna A2 arranged on the upper side of the electronic device. The first antenna A1 may include a first TFA 240 and the second antenna A2 may include a second TFA 250. (Note that antennas A1 and A2 may each be referred to herein as an "antenna structure".)

The first TFA 240 may be arranged such that an antenna terminal AT is directly electrically connected to the PCB of the electronic device 200, and may operate as an independent antenna (rather than as an extension or parasitic radiator of another radiation body). The TFA 240 may be disposed on the cover member mounting surface 231, and may thereby be sandwiched between the cover member mounting surface 231 and the cover member 220 when assembled. In this case, the first TFA 240 may operate as an independent antenna radiation body that is used at at least one desired frequency band.

The second TFA 250 may be configured such that the antenna terminal AT thereof is electrically connected to the metal bezel 210 at the periphery of the electronic device 200 on the cover member mounting surface 231. In this case, the second TFA 250 may be utilized as auxiliary antenna radiation body or as a parasitic antenna of the metal bezel, with the bezel employed as an antenna radiation body. (The TFA 250 may be considered as an extension of the metal bezel which is driven as antenna radiation body.)

Figure 4A:
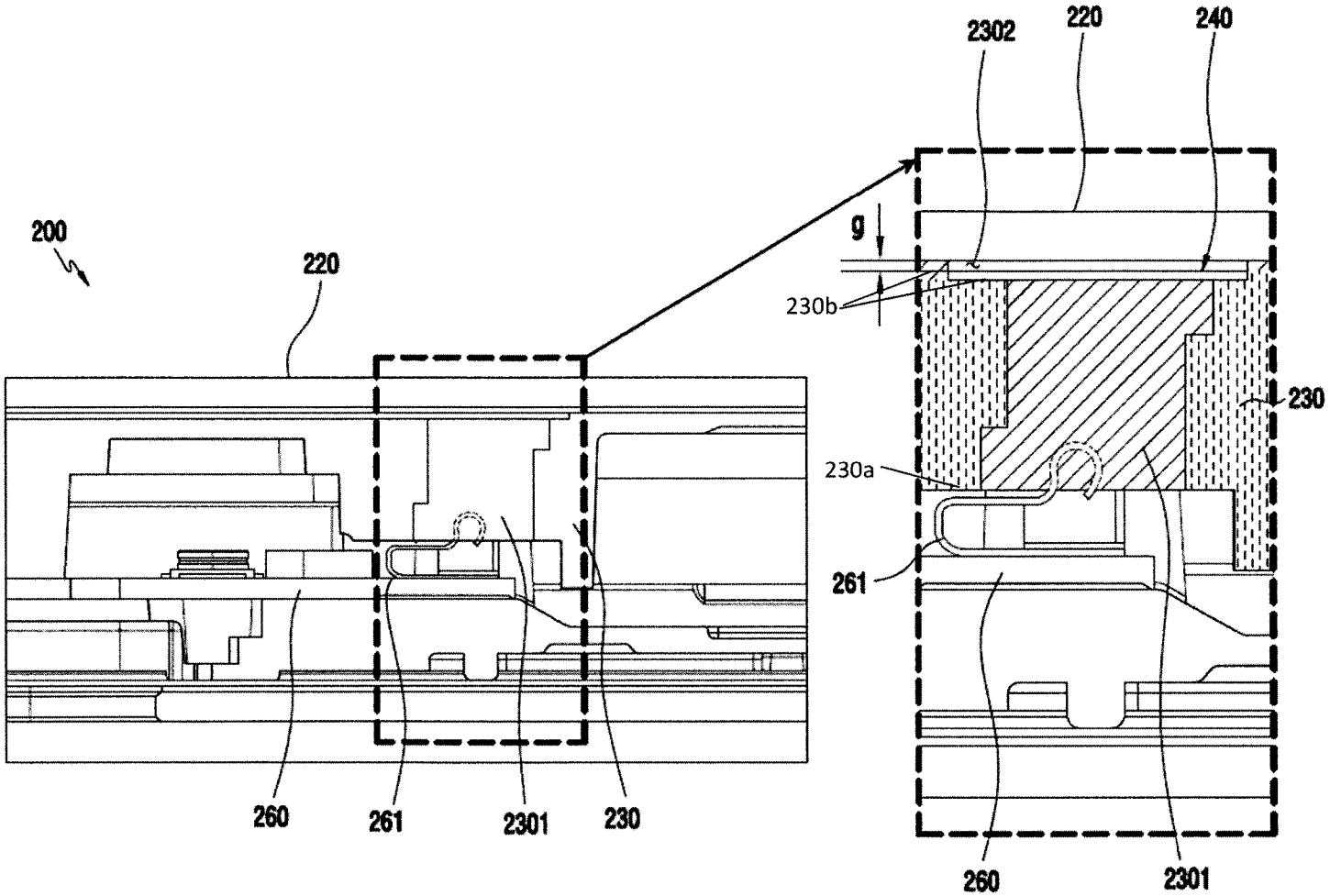
FIG. 4A is a sectional view illustrating a state in which an antenna is arranged in an electronic device according to various embodiments of the present disclosure.

FIG. 4A is a sectional view illustrating a state in which the antenna A1 is arranged in the electronic device 200 according to various embodiments of the present disclosure. Antenna A1 may include first TFA 240 arranged to be exposed adjacent to an outer surface of the rear housing 230, a metal member 2301 (equivalently, "metal structure") arranged in the rear housing 230 and electrically connected to the TFA 240, and a Printed Circuit Board (PCB) 260 arranged in the interior of the electronic device 200, electrically connected to the metal member 2301 by an electrical connection unit, and configured to feed electric power to the TFA 240. (Rear housing 230 may be considered an example of a "non-metal structure" which surrounds metal member 2301 and TFA 240.)

The TFA 240 may be arranged in a recess below the outer surface of the rear housing 230. Because an air gap 2302 having a predetermined height g may be formed between the TFA 240 and the cover member 220, the configuration may prevent an external impact generated by the electronic device 200 from being transferred to the TFA 240.

The metal member 2301 may have a height (in a thickness direction of the rear housing 230) approximately equal to the thickness of the rear housing 230. Metal member 2301 may be formed through insert-molding whereas the rear housing 230 may be formed of a synthetic resin material. Metal member 2301 may be formed through dual injection molding together with the rear housing 230. In this case, after the metal member 2301 is installed to protrude from an upper surface or a lower surface of the rear housing 230, it may be formed to be level with the outer surface of the housing through grinding (planarization). Because the metal member 2301 may have a predetermined area thereof exposed at the upper surface 230*a* (or a first surface) and the lower surface 230*b* (or a second surface) of the rear housing 230, the exposed portion at the upper surface of the rear housing 230 may be electrically connected to a metal radiation body 243 (see FIG. 4B) of the TFA 240 in a surface contact manner. An exposed portion of the metal member 2301 corresponding to the rear housing 230 may make physical contact with a C-clip 261 (or other flexible conductive structure) installed in the feeding unit of the PCB 260 as an electrical connection unit. The electrical connection unit may include various conductive materials such as conductive tape and a metal spring in addition to the C-clip 261.

Hereinafter, an example configuration for TFA 240 will be described in detail.

Figure 4B:
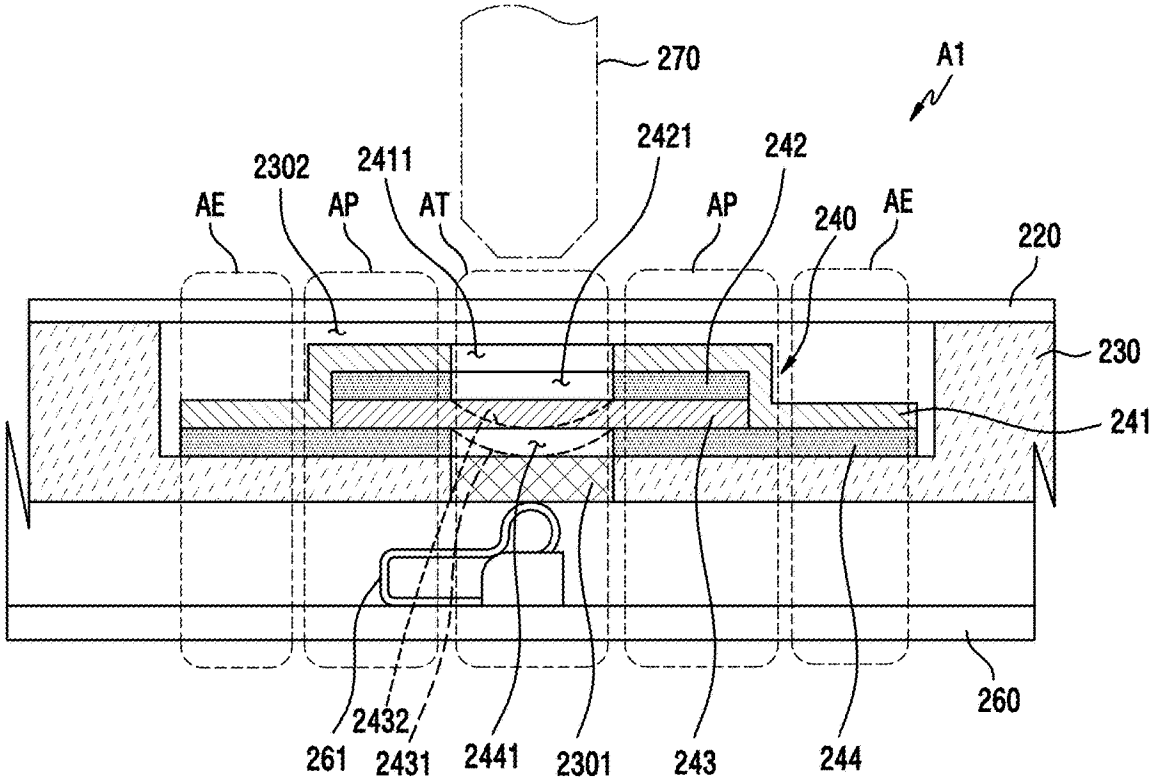
FIG. 4B is a sectional view of a main part of an antenna according to various embodiments of the present disclosure.

FIG. 4B is a sectional view of a main part of the antenna A1 according to various embodiments of the present disclosure. Antenna A1 may include an antenna terminal AT that makes contact with the metal member 2301 of the rear housing 230, an antenna element pattern AP that may have a metal radiation body 243 (which may be referred to herein as a "radiator pattern" or "conductive trace"), and an antenna peripheral area AE which is a peripheral area other than the antenna element pattern AP and the antenna terminal AT.

The TFA 240 may include an antenna support 241 for maintaining the entire shape of the antenna, a metal radiation body 243 laminated on the bottom surface of the antenna support 241 by a first bonding member or layer 242, and a second bonding member or layer 244 attached to the metal radiation body 243 and the antenna support 241. (Antenna support 241 may be also be referred to as an "insulation layer".) According to an embodiment of the present disclosure, because the TFA 240 having the above-described configuration is attached to the rear housing 230, it does not require a separate cover lay film as in the related art and the entire thickness of the TFA 240 decreases, consequently contributing to the slimness of the electronic device 200.

While an existing FPCB type antenna generally has a thickness in the range of 0.1 mm to 0.15 mm, the exemplary TFA 240, according to the present disclosure, can exclude a cover lay film so as to implement a slim thickness in a range of 0.03 mm to 0.08 mm.

The antenna support 241 may employ at least one of Polyimide (PI) and polyethylene terephthalate (PET). Antenna support 241 may be bonded to the metal radiation body 243 by the first bonding member 242. The metal radiation body 243 may be formed of copper, and the exposed portion may be prevented from being corroded through plating (for example, nickel plating or gold plating) to form a metal layer. The antenna support 241, the first bonding member 242, and the metal radiation body 243 may be implemented in the form of a single film through a hot press process. To this end, PI for antenna support 241 and copper for the radiation body 243 may be used to form of a single film through a hot press process via the first bonding member 242.

The second bonding member 244 may be laminated on the lower side of the TFA 240 which may be implemented in the form of a single film through a hot press process. Second bonding member 244 may be a double-sided tape to be easily attached to an outer surface of the rear housing 230. In this case, the double-sided tape 244 may be applied to all of the antenna terminal AT, the antenna element pattern AP, and the antenna peripheral area AE of the TFA 240.

The antenna terminal AT of the TFA 240 may make electrical contact with the metal member 2301, which is exposed to the rear housing 230 in various methods. Openings 2411, 2421, and 2441 may be formed at a location of the antenna terminal AT of the TFA 240 above the metal member 2301, and may each have a circumference coinciding with that of metal member 2301. Opening 2441 may separate a top (exposed) portion 2431 of metal member 2301 and a bottom surface of a portion of radiation and may body 243. Because the exposed portion 2431 of the metal radiation body 243 may be directly welded at an upper portion of the antenna terminal AT by a welding jig 270, the corresponding portion of the metal radiation body 230 may be deformed downwards as illustrated by the dotted arc, to make physical contact with the metal member 2301, which is exposed to the rear housing 230 therebelow. According to an embodiment of the present disclosure, after the TFA 240 is attached to the rear housing 230 by the second bonding member 244, a welding process may be performed. A portion of the antenna element pattern 243 exposed through the openings 2411, 2421 may have at least one convexo-concave portion or a dimple 2432, when viewed from a top of the antenna support 241.

The welding method may include at least one of spot welding, laser welding, and ultrasonic welding.

The antenna A1 may be finished by bringing the bottom surface of the metal member 2301 of the rear housing 230 into physical contact with the PCB 260, to which an electrical connection unit, such as the C-clip 261, is mounted, which electrically connects the metal radiation body 243 to a desired component of the PCB 260. According to an embodiment of the present disclosure, because the uppermost surface of the TFA 240 is arranged to form an air gap 2302 of a predetermined height from the cover member 220, it may be configured such that an external impact applied to the electronic device 200 may not influence the TFA 240 attached to the rear housing 230.

Figure 5A:
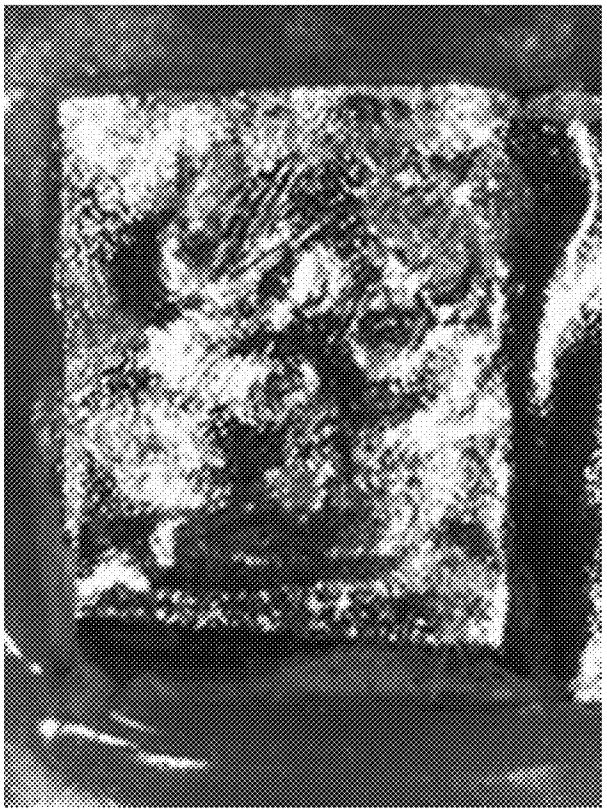
FIG. 5A, FIG. 5B and FIG. 5C are respective photographs showing a terminal exposing part of a TFA due to various welding methods according to various embodiments of the present disclosure.
Figure 5B:
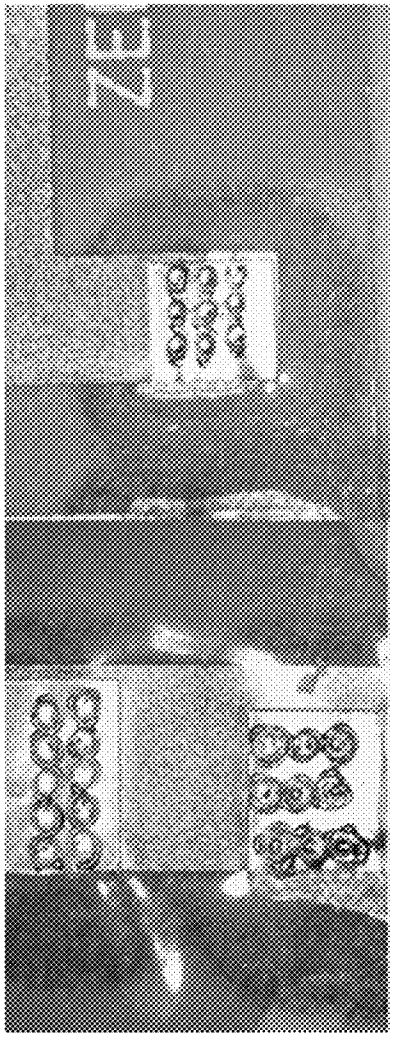
Figure 5C:
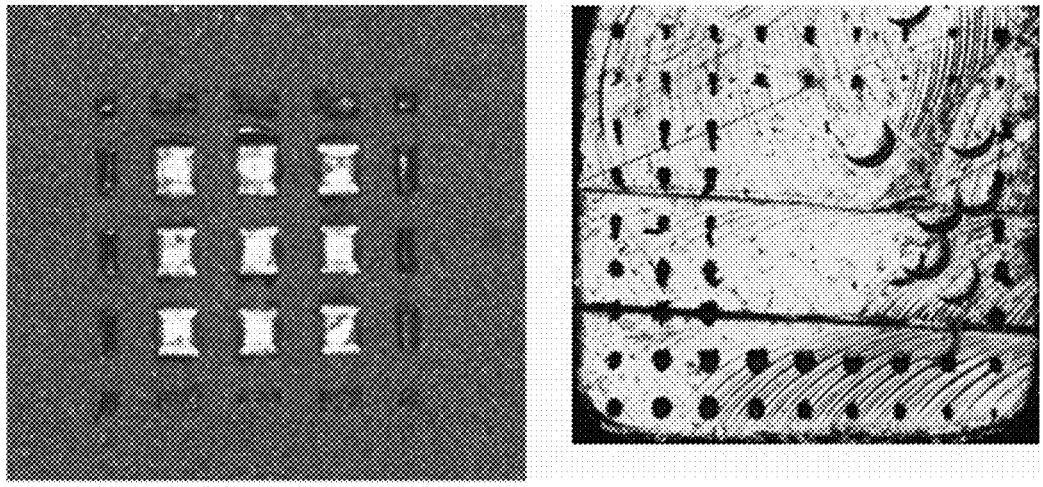

FIGS. 5A to 5C are photographs in experimental devices showing a terminal exposing part of a TFA due to various welding methods according to various embodiments of the present disclosure.

In FIG. 4B, openings 2411, 2421, and 2441 may be formed at a location of the antenna terminal AT of the TFA 240 corresponding to the metal member 2301 of the rear housing 230 except for the metal radiation body 243, and the "terminals" of the metal radiation body 243 may be exposed through the openings 2411, 2421, and 2441. Here, the terminals of metal radiation body 243 refer to the upper and lower portions of body 243 in the area of the openings, where the bottom portion of body 243 may be considered a connection terminal that electrically connects to metal member 2301, and the upper portion may be considered a terminal that may electrically connect to another radiating element if desired.

FIG. 5A is a photograph of the terminal exposing portion of the metal radiation body 243 processed through spot welding, and irregular welding portions may be identified. FIG. 5B is a photo of a terminal exposing portion of the metal radiation body 243 processed through laser welding, and it can be seen that the welding portions are arranged in the terminal exposing portion relatively uniformly. FIG. 5C is a view illustrating a terminal exposing portion (left) of the metal radiation body 243 processed through ultrasonic welding and a terminal surface (right) exposed to the inside of the rear housing. Here, it can be seen that terminal exposing portions having a predetermined interval are arranged on the antenna support 241 at an equal interval.

Thus it is apparent from the above-discussed photographs that the welding method of the metal radiation body 243 may be identified by visually identifying the exposed portion of the metal radiation body 243 of the TFA.

Figure 6A:
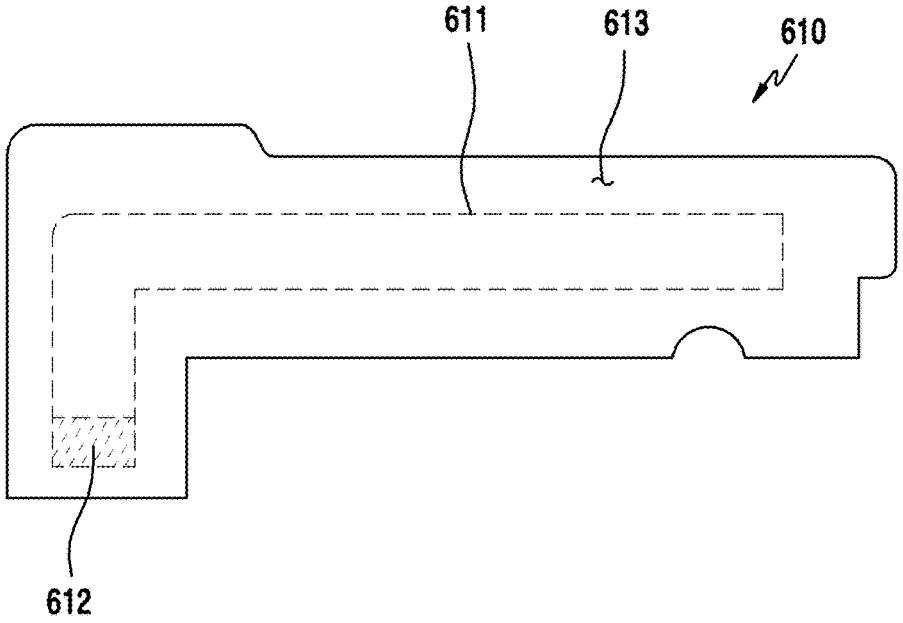
FIG. 6A is plan view of an example TFA according to various embodiments of the present disclosure.
Figure 6B:
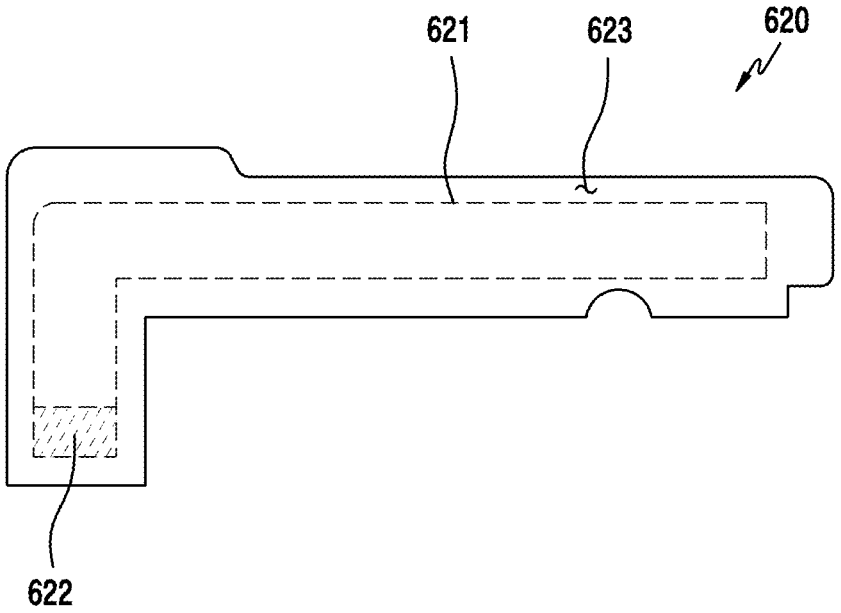
FIG.6B (RELATED ART)
FIG. 6B is a plan view of a related art FPCB type antenna.

FIG. 6A is a plan view of an example TFA, 610, according to various embodiments of the present disclosure. FIG. 6B is a plan view of a conventional FPCB type antenna, 620, with substantially the same radiator pattern as TFA 610. As shown in FIGS. 6A and 6B, the TFA 610 may have an antenna peripheral area 613 that is wider than that of the conventional FPCB type antenna 620. This is caused by the fact that the conventional FPCB type antenna 620 is restricted only to an area having the thickness of the mechanism of the electronic device by applying a cover lay film and the peripheral portion of the antenna is restricted for reduction of a mounting area.

TFA 610 may include an antenna radiator pattern 611 including the antenna terminal 612. It can be seen that the width of the antenna peripheral area 613, which is a region outside the perimeter of the antenna element pattern 611 and the antenna terminal 612, may be wider than that of the antenna peripheral area 623 of the related art (FIG. 6B). In this case, when the TFA 610 is attached to the rear housing of the electronic device, attachment strength may be reinforced by enlarging an attachment area. Reference numerals 621 and 622 denote the antenna radiator pattern 611 and the antenna terminal 612 of the FPCB type antenna 620, respectively.

Figure 7:
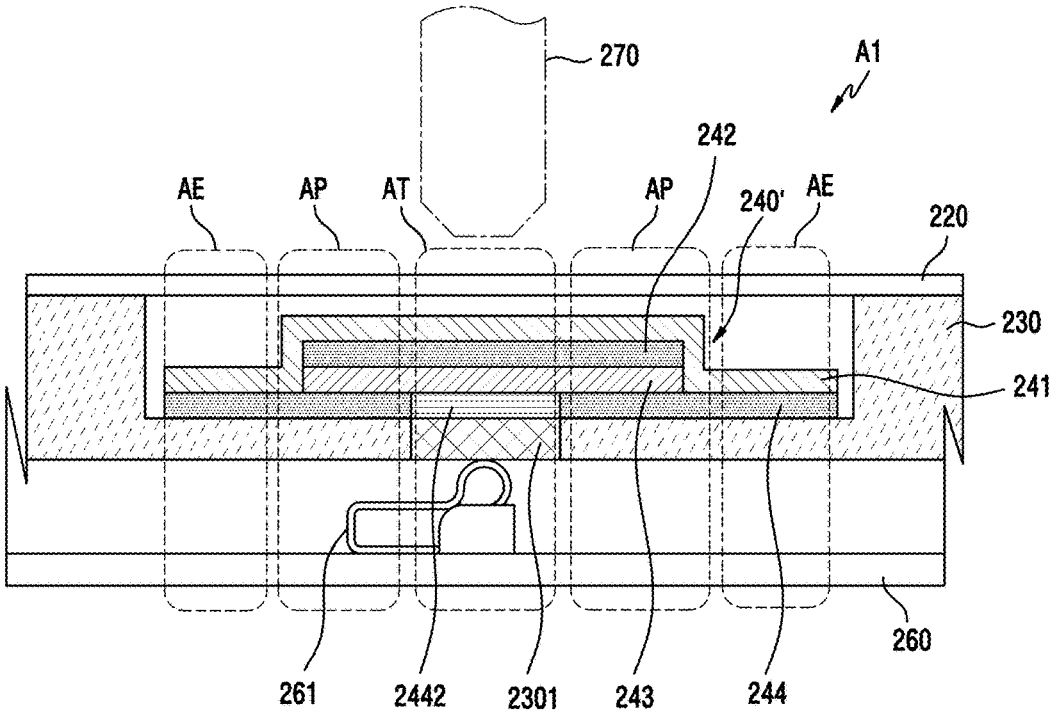
FIG. 7 is a sectional view of a main part of an antenna according to various embodiments of the present disclosure.

FIG. 7 is a sectional view of a main part of an antenna A1 according to various embodiments of the present disclosure. Antenna A1 employs an alternative embodiment for a TFA, 240'. A basic lamination structure of the Thin FPCB Antenna (TFA) 240' and a structure electrically connected to the PCB 260 by a C-clip 261 as described above for FIG. 5 may be the same for the structure in FIG. 7, with the same reference numerals being used; thus a detailed description thereof will be omitted.

As shown in FIG. 7, the TFA 240' may be configured such that the metal radiation body 243 is electrically connected to the metal member 2301 of the rear housing 230 by a conductive medium unit 2442 instead of by welding. A conductive thermally-pressed film may be arranged at a layer level of the second bonding member 244, in a region above the metal member 2301, as the conductive medium unit 2442. The conductive thermally-pressed film may be formed of an Anisotropic Conductive Film (ACF) based resin. According to an embodiment, because the ACF based thermal pressing resin is modified into a conductive body if being heated, the metal radiation body 243 and the metal member 2301 may be electrically connected to each other. In this case, the openings 2411 and 2421 of FIG. 5 formed for use of a welding jig may be excluded from the antenna support 241 and the first bonding member 242 may be disposed on the metal radiation body 243. Further, because the metal radiation body 243 is not exposed from the TFA 240' through the antenna terminal AT when the TFA 240' is finally attached to the rear housing 230, the introduction of foreign substances can be prevented. A predetermined gap (for example, laterally 0.5 mm to 1.0 mm) may be provided to prevent an overlap with a peripheral double-sided tape that occurs due to the spreading thereof as a result of thermal pressing. A double-sided tape may be mounted at a periphery thereof to prevent deformation due to external temperature and humidity.

The basic design of the TFA 250 of antenna A2 shown in FIG. 3 may be the same or similar to either of the embodiments for TFA 240 in FIGS. 5 and 7.

Figure 8:
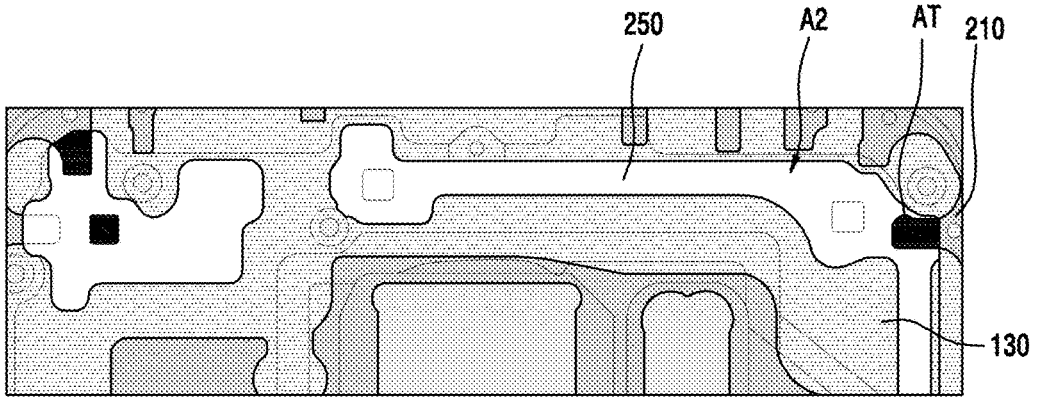
FIG. 8 is a diagram illustrating a state in which an antenna, according to various embodiments of the present disclosure, is electrically connected to a metal bezel of an electronic device.

FIG. 8 is a diagram illustrating a state in which the antenna A2, is electrically connected to the metal bezel 210 of the electronic device 200. Here, an exemplary embodiment of the present disclosure illustrates a configuration in which the antenna terminal AT of the second TFA 250 is electrically connected to a peripheral metal structure of the electronic device 200 instead of being directly connected to the PCB.

In FIG. 8, the TFA 250 may be configured such that the antenna terminal AT is physically connected to the metal bezel 210 of the electronic device. The metal bezel 210 may be formed together with the rear housing 230 of a synthetic resin through a method such as insert-molding or dual insert-molding.

According to various embodiments of the present disclosure, it is preferable that the antenna terminal AT of the TFA 250 is disposed proximate the metal bezel 210, and may make direct contact with the metal bezel 210 or may be connected to the metal bezel 210 by a separate electrical connection means. In this case, when the metal bezel 210 is utilized as an antenna radiation body, the TFA 250 may be utilized as an extension of the antenna radiation body for changing or expanding the bandwidth of the metal bezel antenna.

In the above-described embodiments, an electronic device has been described as including at least one TFA, e.g., TFAs 240 and 250, which have been illustrated and described as being disposed in between a rear housing surface such as surface 231 and a rear cover member or rear wall. In alternative embodiments, one or more TFAs may be additionally or alternatively disposed in between a front housing surface and a front cover member or wall of the electronic device.

Figure 9:
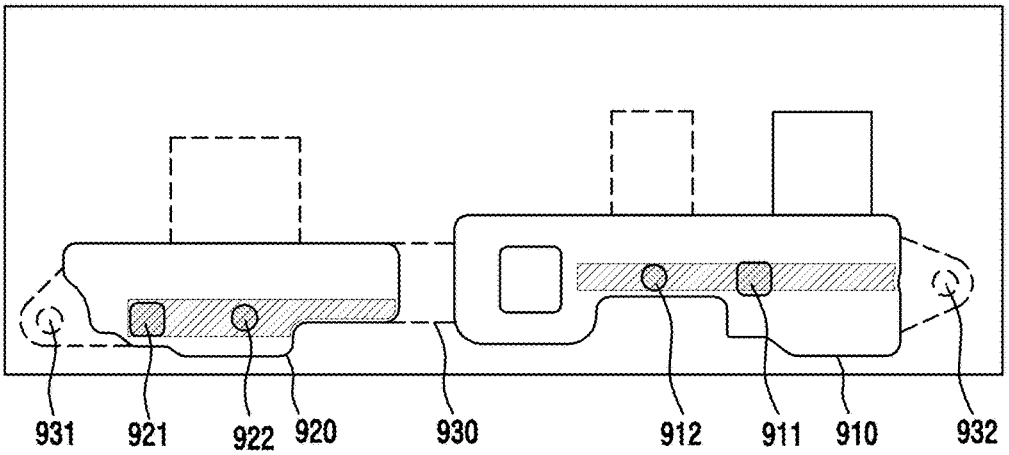
FIG. 9 is a diagram of a TFA assembly before the application of an electronic device according to various embodiments of the present disclosure.

FIG. 9 is a diagram of a TFA assembly before being assembled within an electronic device according to various embodiments of the present disclosure. Because the bonding portions of the double-sided tape of two finished TFAs 910 and 920, which have been exposed before being attached to the rear housing 230, may be contaminated by foreign substances, separation paper (or delamination paper) 930, which is at least wider than the bonding area, may be attached.

Contact resistance parts 912 and 922, from which the metal radiation body may be exposed, may be formed on at least one area of the uppermost surfaces of the finished TFAs 910 and 920 other than the antenna terminals 911 and 921. The contact resistance parts 912 and 922 may function as electrical contact parts used for an antenna performance test of the TFAs 910 and 920.

The separation paper 930 may have position correcting holes 931 and 932 in at least one area where the TFAs 910 and 920 are not located. The position correcting holes 931 and 932 may be mounted on or fitted with a metal boss or a bushing formed in the rear housing 230 when the TFAs 910 and 920 are attached to the rear housing 230. TFAs 910 and 920 may be precisely positioned without deviation of the position thereof by the position correcting holes 931 and 932.

Various embodiments of the present disclosure provide an electronic device including: a front glass cover that defines a front surface of the electronic device; a rear cover that defines a rear surface of the electronic device; a display unit that is embedded in the electronic device and includes a screen area exposed through the front cover; a non-metal structure that is located inside the electronic device and includes a first surface facing the front cover and a second surface facing the rear cover; a metal structure that passes through a portion of the non-metal structure and extends from the first surface to the second surface of the non-metal structure; and an antenna pattern that is arranged at a portion of the first surface or the second surface and is electrically connected to the metal structure, wherein the antenna pattern includes: a first bonding layer that is attached to a portion of the first surface or the second surface and includes an opening formed at a location of the metal structure; a conductive pattern that is arranged on the first bonding layer and is electrically connected to the metal structure through the opening; a second bonding layer that is arranged on the conductive pattern and the first bonding layer; and an insulation layer that is arranged on the second bonding layer.

According to various embodiments of the present disclosure, the antenna pattern further includes an opening part that passes through the second bonding layer and the insulation layer above the opening.

According to various embodiments of the present disclosure, a protrusion that extends from the conductive pattern towards the metal structure is formed in the opening, and the protrusion includes the same metal as that of the conductive pattern.

According to various embodiments of the present disclosure, a portion of the conductive pattern exposed through the opening part has at least one convexo-concave portion or a dimple, when viewed from the top of the insulation layer.

According to various embodiments of the present disclosure, a metal layer is further formed in the opening between a portion of the conductive pattern exposed through the opening part and the metal structure.

According to various embodiments of the present disclosure, the metal structure includes aluminum, the conductive pattern includes copper, and the metal layer includes nickel or gold.

According to various embodiments of the present disclosure, an anisotropic conductive film is further formed in the opening between the metal structure and the conductive pattern.

According to various embodiments of the present disclosure, the electronic device further includes: a flexible conductive structure that forms an electrical connection with the metal structure on the second surface or the first surface.

According to various embodiments of the present disclosure, the antenna pattern is located between the non-metal structure and the rear cover.

According to various embodiments of the present disclosure, the rear cover includes a glass plate.

According to various embodiments of the present disclosure, the electronic device further includes: an external housing that includes a metal, and the external housing is integrally formed with, or attached to, the non-metal structure, and the external housing is electrically connected to the antenna pattern.

According to various embodiments of the present disclosure, when the external housing is used as an antenna radiation body of the electronic device, the antenna pattern is applied as an auxiliary antenna radiation body for expanding or changing the operational frequency band of the external housing.

According to various embodiments of the present disclosure, the metal structure and the conductive pattern make electrical contact with each other through welding.

According to various embodiments of the present disclosure, the conductive pattern is electrically connected to the metal structure through at least one method of spot welding, laser welding, and ultrasonic welding.

According to various embodiments of the present disclosure, separation paper having an area larger than an area, to which the bonding layer is applied, is attached to the antenna pattern to prevent contamination of the bonding layer before the antenna pattern is arranged in the non-metal structure.

According to various embodiments of the present disclosure, an air gap for avoiding mutual contact is formed in at least one of a portion of the metal structure having the antenna pattern and the rear cover.

Figure 10:
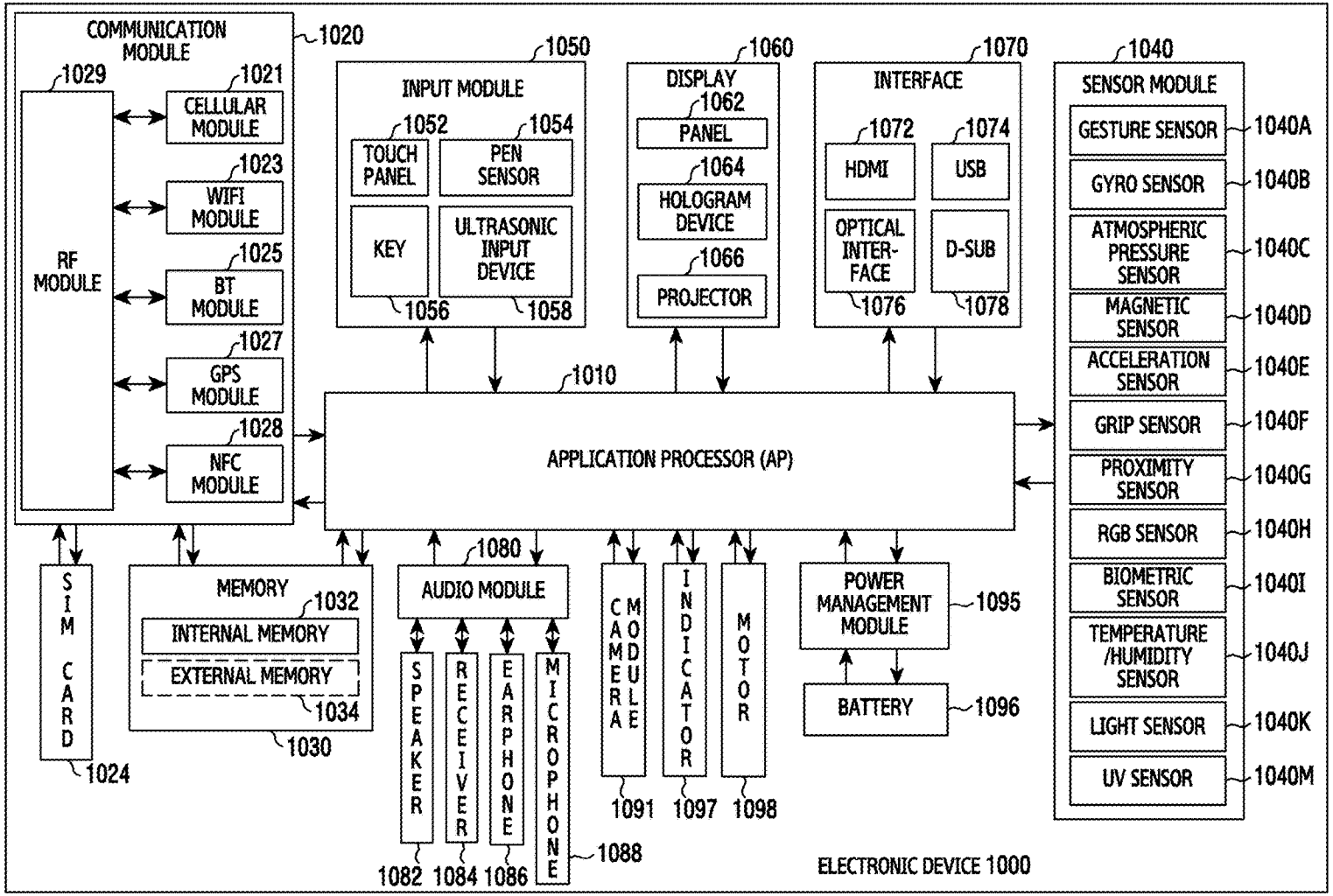
FIG. 10 is a block diagram illustrating an electronic device according to various embodiments of the present disclosure.

FIG. 10 is a block diagram of a configuration of an electronic device according to an embodiment of the present disclosure.

Referring to FIG. 10, a configuration of electronic device 1000 is provided. The electronic device 1000 may entirely or partially constitute the electronic device 101 of FIG. 1, or the device 200 of FIGS. 2A, 2B, and 3. Electronic device 1000 includes at least one AP 1010, a communication module 1020, a subscriber identification module (SIM) card 1024, a memory 1030, a sensor module 1040, an input device 1050, a display 1060, an interface 1070, an audio module 1080, a camera module 1091, a power management module 1095, a battery 1096, an indicator 1097, and a motor 1098.

The AP 1010 controls a plurality of hardware or software elements connected to the AP 1010 by driving an operating system or an application program. The AP 1010 processes a variety of data, including multimedia data, and performs arithmetic operations. The AP 1010 may be implemented, for example, with a System on Chip (SoC). The AP 1010 may further include a Graphical Processing Unit (GPU).

The communication module 1020 (e.g., the communication interface 160) performs data transmission/reception in communication between other electronic devices (e.g., the external electronic device 104 or the server 106) connected with the electronic device 1000 through a network. The communication module 1020 includes a cellular module 1021, a Wi-Fi module 1023, a BT module 1025, a GPS module 1027, a NFC module 1028, and a radio frequency (RF) module 1029.

The cellular module 1021 provides a voice call, a video call, a text service, an internet service, and the like, through a communication network (e.g., LTE, LTE-A, CDMA, WCDMA, UMTS, WiBro, and GSM, and the like). In addition, the cellular module 1021 identifies and authenticates the electronic device 1000 within the communication network by using a SIM card 1024. The cellular module 1021 may perform at least some of functions that can be provided by the AP 1010. For example, the cellular module 1021 may perform at least some of multimedia control functions.

The cellular module 1021 includes a Communication Processor (CP). Further, the cellular module 1021 may be implemented, for example, with an SoC. Although elements, such as the cellular module 1021 (e.g., the CP), the memory 1030, and the power management module 1095 are illustrated as separate elements with respect to the AP 1010 in FIG. 10, the AP 1010 may also be implemented such that at least one part (e.g., the cellular module 1021) of the aforementioned elements is included in the AP 1010.

The AP 1010 or the cellular module 1021 (e.g., the CP) loads an instruction or data, which is received from each non-volatile memory connected thereto or at least one of different elements, to a volatile memory and processes the instruction or data. In addition, the AP 1010 or the cellular module 1021 stores data, which is received from at least one of different elements or generated by at least one of different elements, into the non-volatile memory.

Each of the Wi-Fi module 1023, the BT module 1025, the GPS module 1027, and the NFC module 1028 includes a processor for processing data transmitted/received through a corresponding module. Although the cellular module 1021, the Wi-Fi module 1023, the BT module 1025, the GPS module 1027, and the NFC module 1028 are illustrated in FIG. 10 as separate blocks, according to an embodiment of the present disclosure, at least some (e.g., two or more) of the cellular module 1021, the Wi-Fi module 1023, the BT module 1025, the GPS module 1027, and the NFC module 1028 may be included in one integrated chip (IC) or IC package. For example, at least some of processors corresponding to the cellular module 1021, the Wi-Fi module 1023, the BT module 1025, the GPS module 1027, and the NFC module 1028 (e.g., a communication processor corresponding to the cellular module 1021 and a Wi-Fi processor corresponding to the Wi-Fi module 1023) may be implemented with an SoC.

The RF module 1029 transmits/receives data, for example an RF signal. The RF module 1029 may include, for example, a transceiver, a Power Amp Module (PAM), a frequency filter, a Low Noise Amplifier (LNA), and the like. In addition, the RF module 1029 may further include a component for transmitting/receiving a radio wave on a free space in wireless communication, for example, a conductor, a conducting wire, and the like. Although it is illustrated in FIG. 10 that the cellular module 1021, the Wi-Fi module 1023, the BT module 1025, the GPS module 1027, and the NFC module 1028 share one RF module 1029, according to an embodiment of the present disclosure, at least one of the cellular module 1021, the Wi-Fi module 1023, the BT module 1025, the GPS module 1027, the NFC module 1028 may transmit/receive an RF signal via a separate RF module.

The SIM card 1024 is inserted into a slot formed at a specific location of the electronic device 1000. The SIM card 1024 includes unique identification information (e.g., an Integrated Circuit Card IDentifier (ICCID)) or subscriber information (e.g., an International Mobile Subscriber Identity (IMSI)).

The memory 1030 (e.g., the memory 100) includes an internal memory 1032 or an external memory 1034.

The internal memory 1032 may include, for example, at least one of a volatile memory (e.g., a Dynamic Random Access Memory (DRAM), a Static RAM (SRAM), a Synchronous Dynamic RAM (SDRAM), and the like) or a non-volatile memory (e.g., a One-Time Programmable Read Only Memory (OTPROM), a Programmable ROM (PROM), an Erasable and Programmable ROM (EPROM), an electrically erasable and programmable ROM (EEPROM), a mask ROM, a flash ROM, a Not AND (NAND) flash memory, a Not OR (NOR) flash memory, and the like). The internal memory 1032 may be a solid state drive (SSD).

The external memory 1034 may include a flash drive, and may further include, for example, Compact Flash (CF), Secure Digital (SD), micro-SD, mini-SD, extreme digital (xD), memory stick, and the like. The external memory 1034 may be operatively coupled to the electronic device 1000 via various interfaces.

The electronic device 1000 may further include a storage unit (or a storage medium), such as a hard drive.

The sensor module 1040 measures a physical quantity or detects an operation state of the electronic device 1000, and converts the measured or detected information into an electric signal. The sensor module 1040 includes, for example, at least one of a gesture sensor 1040A, a gyro sensor 1040B, a barometric pressure sensor 1040C, a magnetic sensor 1040D, an acceleration sensor 1040E, a grip sensor 1040F, a proximity sensor 1040G, a color sensor 1040H (e.g., a red, green, blue (RGB) sensor), a biometric sensor 1040I, a temperature/humidity sensor 1040J, an illumination sensor 1040K, and an ultraviolet (UV) sensor 1040M. Additionally or alternatively, the sensor module 1040 may include, for example, an E-node sensor, an electromyography (EMG) sensor, an electroencephalogram (EEG) sensor, an electrocardiogram (ECG) sensor, a fingerprint sensor, and the like. The sensor module 1040 may further include a control circuit for controlling at least one or more sensors included therein.

The input device 1050 includes a touch panel 1052, a (digital) pen sensor 1054, a key 256, or an ultrasonic input unit 1058.

The touch panel 1052 recognizes a touch input, for example, by using at least one of an electrostatic type, a pressure-sensitive type, and an ultrasonic type. The touch panel 1052 may further include a control circuit. In case of the electrostatic type of touch panel 1052, not only is physical contact recognition possible, but proximity recognition is also possible. The touch penal 1052 may further include a tactile layer. In this case, the touch panel 1052 provides the user with a tactile reaction.

The (digital) pen sensor 1054 may be implemented, for example, by using the same or similar method of receiving a touch input of the user or by using an additional sheet for recognition.

The key 1056 may be, for example, a physical button, an optical key, a keypad, or a touch key.

The ultrasonic input unit 1058 is a device by which the electronic device 1000 detects a sound wave through a microphone 1088 by using a pen which generates an ultrasonic signal, and is capable of radio recognition.

The electronic device 1000 may use the communication module 1020 to receive a user input from an external device (e.g., a computer or a server) connected thereto.

The display 1060 (e.g., the display 150) includes a panel 1062, a hologram device 1064, or a projector 1066.

The panel 1062 may be, for example, a Liquid-Crystal Display (LCD), an Active-Matrix Organic Light-Emitting Diode (AM-OLED), and the like. The panel 1062 may be implemented, for example, in a flexible, transparent, or wearable manner. The panel 1062 may be constructed as one module with the touch panel.

The hologram device 1064 uses an interference of light and displays a stereoscopic image in the air.

The projector 1066 displays an image by projecting a light beam onto a screen. The screen may be located inside or outside the electronic device 1000.

The display 1060 may further include a control circuit for controlling the panel 1062, the hologram device 1064, or the projector 1066.

The interface 1070 includes, for example, an HDMI 1072, a USB 1074, an optical communication interface 1076, or a D-subminiature (D-sub) 1078. The interface 1070 may be included, for example, in the communication interface 160 of FIG. 1. Additionally or alternatively, the interface 1070 may include, for example, Mobile High-definition Link (MHL), SD/Multi-Media Card (MMC) or Infrared Data Association (IrDA).

The audio module 1080 bilaterally converts a sound and electric signal. At least some elements of the audio module 1080 may be included in the input/output interface 100 of FIG. 1. The audio module 1080 converts sound information which is input or output through a speaker 1082, a receiver 1084, an earphone 1086, the microphone 1088, and the like.

The camera module 1091 is a device for image and video capturing, and may include one or more image sensors (e.g., a front sensor or a rear sensor), a lens, an Image Signal Processor (ISP), or a flash (e.g., an LED or a xenon lamp).

The power management module 1095 manages power of the electronic device 1000. The power management module 1095 may include a Power Management Integrated Circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 1096 and a voltage, current, and temperature during charging. The battery 1096 stores or generates electricity and supplies power to the electronic device 1000 by using the stored or generated electricity. The battery 1096 may include a rechargeable battery or a solar battery.

The indicator 1097 indicates a specific state, for example, a booting state, a message state, a charging state, and the like, of the electronic device 1000 or a part thereof (e.g., the AP 1010).

The motor 1098 converts an electric signal into a mechanical vibration.

The electronic device 1000 includes a General Processing Unit (e.g., a GPU) for supporting mobile TV. The GPU for supporting mobile TV processes media data according to a protocol of, for example, Digital Multimedia Broadcasting (DMB), Digital Video Broadcasting (DVB), media flow, and the like.

Each of the aforementioned elements of the electronic device according to various embodiments of the present disclosure may consist of one or more components, and names thereof may vary depending on a type of electronic device. The electronic device according to various embodiments of the present disclosure may include at least one of the aforementioned elements. Some of the elements may be omitted, or additional other elements may be further included. In addition, some of the elements of the electronic device may be combined and constructed as one entity, so as to equally perform functions of corresponding elements before combination.

The term "module" used herein may refer to one of hardware, software, and firmware, or a combination thereof. The term "module" may be interchangeably used with terms, such as unit, logic, logical block, component, circuit, and the like, with the module being a minimum unit of an integrally constituted component or may be a part thereof. The module may be a minimum unit for performing one or more functions, or may be a part thereof, with the module being mechanically or electrically implemented, e.g., by at least one of an application-specific IC (ASIC) chip, a field-programmable gate arrays (FPGAs), and a programmable-logic device.

According to various embodiments of the present disclosure, at least some parts of a device (e.g., modules or functions thereof) or method (e.g., operations) may be implemented with an instruction stored in a computer-readable storage media for example. The instruction may be executed by one or more processors (e.g., the AP 1010), to perform a function corresponding to the instruction. The computer-readable storage media may be, for example, the memory 1030. At least some parts of the programming module may be implemented (e.g., executed), for example, by the AP 1010. At least some parts of the programming module may include modules, programs, routines, sets of instructions, processes, and the like, for performing one or more functions.

Certain aspects of the present disclosure may also be embodied as computer readable code on a non-transitory computer readable recording medium. A non-transitory computer readable recording medium is any data storage device that can store data which can be thereafter read by a computer system. Examples of the non-transitory computer readable recording medium include a Read-Only Memory (ROM), a Random-Access Memory (RAM), Compact Disc-ROMs (CD-ROMs), magnetic tapes, floppy disks, and optical data storage devices. The non-transitory computer readable recording medium can also be distributed over network coupled computer systems so that the computer readable code is stored and executed in a distributed fashion. In addition, functional programs, code, and code segments for accomplishing certain aspects of the present disclosure will be recognized from the disclosure herein and constructed by programmers having ordinary skill skilled in the art.

The various embodiments of the present disclosure as described above typically involve the processing of input data and the generation of output data to some extent. This input data processing and output data generation may be implemented in hardware or software in combination with hardware. For example, specific electronic components may be employed in a mobile device or similar or related circuitry for implementing the functions associated with the various embodiments of the present disclosure, as described above. Alternatively, one or more processors operating in accordance with stored instructions may implement the functions associated with the various embodiments of the present disclosure, as described above. If such is the case, it is within the scope of the present disclosure that such instructions may be stored on one or more non-transitory processor readable mediums. Examples of the processor readable mediums include a ROM, a RAM, CD-ROMs, magnetic tapes, floppy disks, and optical data storage devices. The processor readable mediums can also be distributed over network coupled computer systems so that the instructions are stored and executed in a distributed fashion. In addition, functional computer programs, instructions, and instruction segments for accomplishing the present disclosure will be recognized from the disclosure herein and construed by programmers having ordinary skill in the art.

The module or programming module according to various embodiments of the present disclosure may further include at least one or more elements among the aforementioned elements, may omit some of them, or may further include additional elements. Operations performed by a module, programming module, or other elements may be executed in a sequential, parallel, repetitive, or heuristic manner. In addition, some of the operations may be executed in a different order or may be omitted, or other operations may be added.

While embodiments of the present disclosure have been shown and described, it will be understood by those skilled in the art that various changes in form and details may be made therein without departing from the spirit and scope of the present disclosure, as defined by the appended claims and equivalents thereof.

What is claimed is:

1. An electronic device comprising:

a front glass cover defining a front surface of the electronic device;

a rear cover defining a rear surface of the electronic device;

a display comprising a screen area exposed through the front cover;

a non-metal structure disposed in the electronic device and comprising a first surface facing the front cover and a second surface facing the rear cover;

a metal structure disposed through a portion of the non-metal structure, such that a predetermined area of the metal structure is exposed through the first surface to the second surface of the non-metal structure; and an antenna structure disposed at a portion of the first surface or the second surface of the non-metal structure and being electrically connected to the metal structure, wherein the antenna structure comprises:

a second bonding layer attached to a portion of the second surface of the non-metal structure, and including a first opening corresponding to the metal structure, an antenna element pattern arranged on the second bonding layer and electrically connected to the metal structure through the first opening, a first bonding layer arranged on the antenna element pattern and an insulation layer arranged on the first bonding layer, wherein the first bonding layer and the insulation layer form a second opening above the first opening, and wherein the metal structure contacts to a conductive connector for supplying a power, and the conductive connector is distinct from the metal structure.

2. The electronic device of claim 1, wherein a protrusion that extends from the antenna element pattern towards the metal structure is formed in the first opening.

3. The electronic device of claim 1, wherein a portion of the antenna element pattern exposed through the first opening or the second opening has at least one convexo-concave portion or a dimple, when viewed from a top of the insulation layer.

4. The electronic device of claim 1, wherein a metal layer is further formed on a portion of the antenna element pattern exposed through the second opening.

5. The electronic device of claim 4, wherein the metal structure comprises aluminum, the antenna element pattern comprises copper or aluminum, and the metal layer comprises nickel or gold.

6. The electronic device of claim 1, wherein an anisotropic conductive film is further formed in the first opening between the metal structure and the antenna element pattern.

7. The electronic device of claim 1, further comprising:

a flexible conductive structure that forms an electrical connection with the metal structure on the first surface.

8. The electronic device of claim 1, wherein the antenna structure is located between the non-metal structure and the rear cover.

9. The electronic device of claim 1, wherein the rear cover comprises a glass plate.

10. The electronic device of claim 1, further comprising:

an external housing that comprises a metal, wherein the external housing is integrally formed with, or attached to, the non-metal structure, and the external housing is electrically connected to the antenna element pattern.

11. The electronic device of claim 10, wherein when the external housing is used as an antenna radiation body of the electronic device, the antenna element pattern is applied as an auxiliary antenna radiation body for expanding or changing an operational frequency band of the external housing.

12. The electronic device of claim 1, wherein the metal structure and the antenna element pattern electrically contact with each other through welding.

13. The electronic device of claim 12, wherein an exposing portion of the antenna element pattern exposed through an opening is welded.

14. The electronic device of claim 12, wherein the antenna element pattern is electrically connected to the metal structure through at least one method of spot welding, laser welding, and ultrasonic welding.

15. The electronic device of claim 1, wherein an air gap for avoiding mutual contact is formed in at least one of a portion of the metal structure having the antenna structure and the rear cover.

* * * * *